United States Patent [19]

Speich

[11] Patent Number: 4,657,053

[45] Date of Patent: Apr. 14, 1987

[54] NEEDLE RIBBON WEAVING MACHINE

[75] Inventor: Francisco Speich, Gipf-Oberfrick, Switzerland

[73] Assignee: Textilma A G, CH-Hergiswil, Switzerland

[21] Appl. No.: 744,002

[22] PCT Filed: Sep. 27, 1984

[86] PCT No.: PCT/CH84/00157

§ 371 Date: Jun. 3, 1985

§ 102(e) Date: Jun. 3, 1985

[87] PCT Pub. No.: WO85/01524

PCT Pub. Date: Apr. 11, 1985

[30] Foreign Application Priority Data

Oct. 6, 1983 [CH] Switzerland ..... 5434/83

[51] Int. Cl.[4] ..... D03D 47/27

[52] U.S. Cl. ..... 139/449

[58] Field of Search ..... 139/429, 431, 432, 442, 139/449

[56] References Cited

U.S. PATENT DOCUMENTS 3,901,285 8/1975 Griffith .
4,243,076 1/1981 Mallard ..... 139/449

FOREIGN PATENT DOCUMENTS 2939883 4/1980 Fed. Rep. of Germany .
2918062 1/1981 Fed. Rep. of Germany .
2228125 11/1974 France .
633329 11/1982 Switzerland .
633331 11/1982 Switzerland .
1397054 6/1975 United Kingdom .
2020320 11/1979 United Kingdom .
2033933 5/1980 United Kingdom .

*Primary Examiner*—Henry S. Jaudon
*Attorney, Agent, or Firm*—Michael J. Striker

[57] ABSTRACT

A needle-ribbon weaving machine having a main drive shaft (2) to which are connected a weft needle drive (4), a reed or weaving blade drive (6), a knitting needle drive (8) and a shedding or yarn forming drive (10). A crank pin (22) connected to the main drive shaft (2) is connected by a connecting rod (24) to a rocking lever (28) of the reed or weaving blade drive (6). The weft needle drive (4) is not directly connected to the main drive shaft (2) but, in order to reduce noise and to improve the efficiency, it is articulated by a coupling rod (40) to a rocking rod (38) connected to the rocking lever (28) through a shaft (30).

6 Claims, 4 Drawing Figures

NEEDLE RIBBON WEAVING MACHINE

The invention relates to a needle strip needle ribbon weaving machine in accordance with the preamble of claim 1.

Needle strip weaving machines of the aforementioned type are known, for example, from CH-PS No. 633 331. The weft needle drive as well as the weaving blade drive are driven by a common main drive shaft in this known needle strip weaving machine. A disc with a crankshaft is provided on the main drive shaft having diametrally opposed disposed crankshaft pins, whereby the one crankshaft pin is connected with the weft needle drive by means of a connecting rod and the other crankshaft pin is connected with the weaving blade drive also by means of a connecting rod. Thus, the weaving blade drive and the weft needle drive are subjected to an opposite directed movement. Good results are obtained with such a needle strip weaving machine. However, much is still to be desired with respect to the noise development as well as with respect to the drive output.

It is therefore an object of the invention to improve a needle strip weaving machine of the aforementioned type wherein the noise development is reduced and the output can be increased.

This object is surprisingly solved by the characterizing features of claim 1. In view of the fact that the weft needle drive is no longer connected by itself on the main drive shaft by means of a crankshaft pin, but is connected with a rocker arm of the weaving blade drive by means of a coupling rod results in the advantage that a substantial increase of the output of the needle strip weaving machine is made possible in a surprising manner, while at the same time a reduction in the noise development is achieved.

Advantageous embodiments of the needle strip weaving machine are described in claims 2 to 7.

Particularly favorable conditions with respect to an increase in output and reduction in noise may be obtained with the embodiment in accordance with claim 2. The rocker arms, which are connected by the coupling rod and which connects the weaving blade drive with the weft needle drive, may have different lengths. However, a design in accordance with claim 3 is still more advantageous. A further improvement with respect to the increase in the output and the reduction in noise is made possible by a further embodiment in accordance with claim 4. Although, the rocker arms, which are connected to the coupling rod, are disposed in one direction in accordance with claim 6, may also be disposed in opposite directions in accordance with claim 5 which provides particularly advantageous conditions. This favors the mass balance of the drives.

Claim 7 shows a very simple solution of the needle strip weaving machine, since an additional rocker arm on the weaving blade drive is not required.

Figure 1:
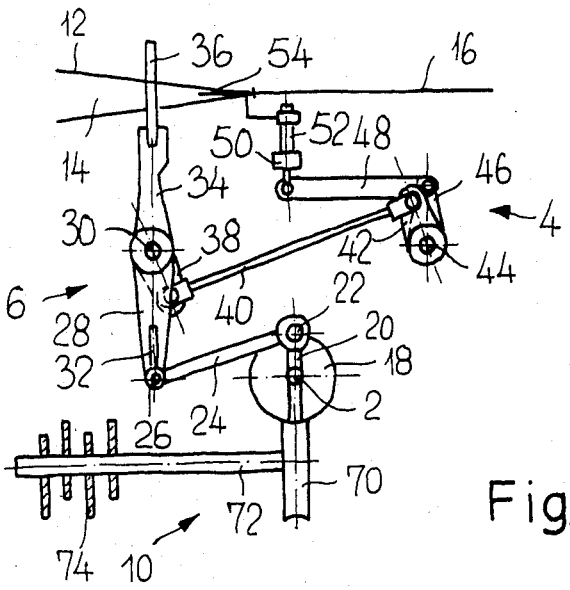
Figure 2:
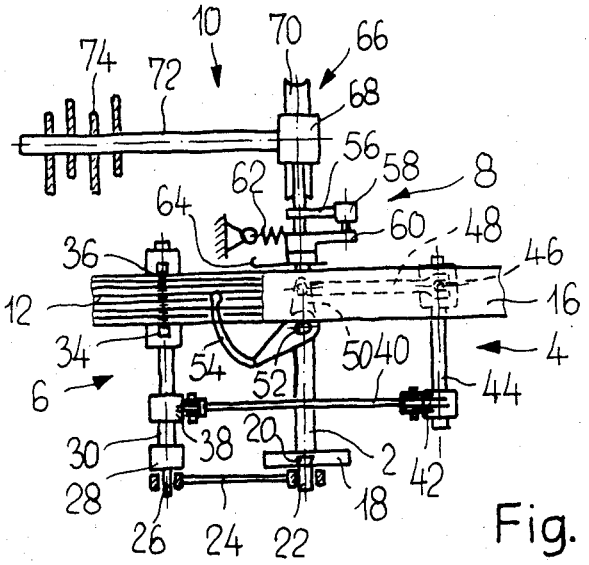
Figure 3:
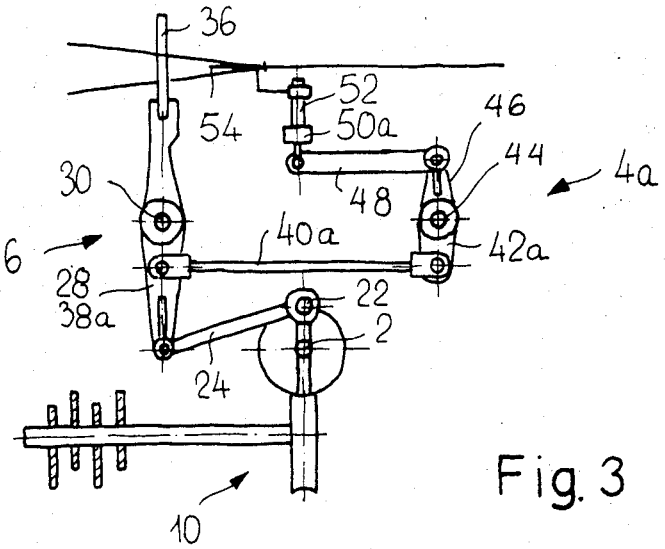
Figure 4:
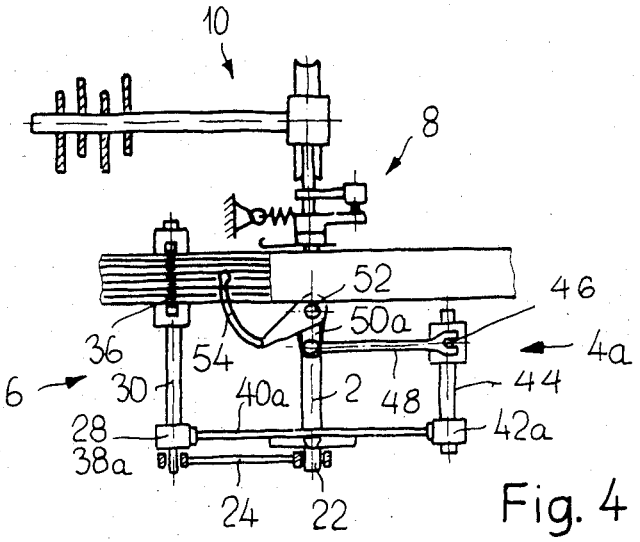

Exemplified embodiments of the inventive needle strip weaving machine are described in more detail in conjunction with schematic drawings which show:

FIG. 1 a first needle strip weaving machine, whereby the coupling rod which connects the weaving blade drive with the weft needle drive is mounted on oppositely directed rocker arms, shown in a side view;

FIG. 2 the needle strip weaving machine of FIG. 1 in a plan view;

FIG. 3 a second needle strip weaving machine, whereby the coupling rod which connects the weaving blade drive with the weft needle drive is mounted on rocker arms disposed in the same direction, in a side view; and FIG. 4 the needle strip weaving machine of FIG. 3 in a plan view.

The weaving machine illustrated schematically in FIGS. 1 and 2 contains a main drive shaft 2 on which a weft needle drive 4, a weaving blade drive 6, a knitting needle drive 8 and a yarn forming drive 10 are connected. Furthermore, warp threads 12, the warp compartment 14 and a woven strip 16 are indicated.

A disc 18 is mounted on main drive shaft 2 which contains a radially adjustably guided crankshaft pin 22 in a dovetail like groove 20, so that the excentricity of the crankshaft pin is adjustable. A connecting rod 24 is connected to the crankshaft pin 22 which is mounted on a rocking lever 28 by means of a joint bolt 26, whereby the rocker lever is stationary connected with a shaft 30.

A longitudinal guide 32 which is disposed in rocking lever 28 serves to adjust the effective lever length of the rocking lever 28. Furthermore, an arm 34 is stationary disposed on shaft 30 which supports on its free end a weaving blade 36.

Furthermore, a rocker arm 38 is stationary mounted on shaft 30 of the weaving blade drive 6 at which a coupling rod 40 is pivotably connected which in turn is pivotably connected with a rocker arm 42 which is provided on the weft needle drive 4. This rocker arm 42 is stationarily connected with a shaft 44 which supports a further rocker arm 46 on which a further rocker arm 50 is connected by means of a further coupling rod 48, whereby this further rocker arm is mounted on a vertical shaft 52. The latter supports the warp compartment 14 at the upper end into which weft needle 54 engages.

In the mean movement phase of the weaving blade drive 6 being illustrated in FIGS. 1 and 2, the oppositely directed and uniformly long rocker arms 38,42 form a right angle with the coupling rod 40.

FIGS. 1 and 2 also show the knitting needle drive 8 which is provided with with a cam plate 56 being mounted on the main drive shaft 2, whereby a cam 58 of a two armed rocker lever 60 engages on this cam plate. A spring 62 pushes the cam 58 against the cam plate 56. At the end of the rocking lever 60 facing away from cam 58 a knitting needle 64 is mounted which in a known manner engages at one side of the strip to be made and which also serves to tie the weft thread loops which are fed by the weft needle 54 into the warp compartment.

The yarn forming drive 10 which is also connected to the main drive shaft 2 contains a single-stage drive 66 which is formed by a worm gear 68 which is connected with the main drive shaft 2 and a worm gear wheel 70 which is mounted on an auxiliary drive shaft 72 on which different excenter 74 are mounted which drive shafts in known manner, but which are not shown in detail.

The needle strip weaving machine schematically shown in FIGS. 3 and 4 corresponds to the one shown in FIGS. 1 and 2, whereby the coupling of the weft needle drive 4*a* with the weaving blade drive 6 is modified to the extent that the coupling rod 40*a* is disposed on uniformly directed rocker arms 38*a* and 42*a*. Thereby the rocker arm 38*a* which is connected with the shaft 30 of the weaving blade drive 6 is formed by the rocking lever 28 of the weaving blade drive 6. Since the rocking arm 42*a* is directed in the same direction as rocker arm 38*a* the movement of the rocker arms is performed in the same direction. However, in order to achieve a countermovement between the weaving blade 36 and the weft needle 54 the rocker arm 50*a* is disposed on the same side of shaft 52 on which the weft needle 54 is mounted. Thus, a counter moving between the weft needle 54 and the weaving blade 36 is again achieved.

As shown in the examples, the length of rocker arms 38,38*a* as well as 42,42*a* are shorter than the length of the rocking lever 28 connected with the connecting rod 24.

REFERENCE NUMERAL LIST

2 main drive shaft
4 weft needle drive
4*a* weft needle drive
6 weaving blade drive
8 knitting needle drive
10 yarn forming drive
12 warp thread
14 warp compartment
16 strip
18 disc
20 groove
22 crankshaft
24 connecting rod
26 joint bolt
28 rocking lever
30 shaft
32 longitudinal guide
34 arm
36 weaving blade
38 rocker arm
38*a* rocker arm
40 coupling rod
40*a* coupling rod
42 rocker arm
42*a* rocker arm
44 shaft
46 rocker arm
48 coupling rod
50 rocker arm
50*a* rocker arm
52 shaft
54 weft needle
56 cam plate of 8
58 cam
60 rocking lever
62 spring
64 knitting needle
66 drive 10
68 worm gear
70 worm gear wheel
72 auxiliary drive
74 excenter

I claim:

1. A needle-ribbon weaving machine having a warp compartment (14) and conveying finished goods (16) along a predetermined path and comprising:

a rotatable main drive shaft (2) arranged traverse with respect to the path, a crankshaft pin (22) rotatable in association with said main drive shaft (2);

a connecting rod (24) pivotally connected to said crankshaft pin (22);

weaving blade drive means (6) including a first rocking lever (28) pivotally connected to said connecting rod (24) and a shaft (30) coupled to said first rocking lever (28); and weft needle drive means (4) including a first coupling rod (40), a second rocking lever (38) pivotally connected to said first coupling rod (40), a third rocking lever (42) pivotally connected to said first coupling rod (40), said second ranking lever (38) being coupled to said shaft (30), an intermediate shaft (44) parallel to said main drive shaft (2) and coupled to said third rocking lever (42) and supporting a fourth rocker arm (46), a second coupling rod (48) pivotally connected to said fourth rocker arm (46), a fifth rocker arm (50) pivotally connected to said second coupling (48), a vertical shaft (52) mounting said fifth rocker arm (50), a sickle-shaped weft needle (54) connected to said fifth rocker arm (50), such that said weft needle (54) is movable in and out of said warp compartment (14), said weaving blade drive (6) being movable to a mean movement phase, said first coupling rod (40) during said mean movement phase of the weaving blade drive (6) forming an angle of about 90° together with said second and third connected rocker levers (38; 42).

2. Needle-ribbon weaving machine as defined in claim 1, wherein said second and third rocker levers (38; 42) have an equivalent length.

3. Needle-ribbon weaving machine as defined in claim 1, wherein said second and third rocker levers (38; 42) are shorter than said first rocking lever.

4. Needle-ribbon weaving machine as defined in claim 1, wherein said second and third rocker levers (38; 42) are directed in opposite directions.

5. A needle-ribbon weaving machine having a warp compartment (14) and conveying finished goods (16) along a predetermined path and comprising:

a rotatable main drive shaft (2) arranged traverse with respect to the path, a crankshaft pin (22) rotatable in association with said main drive shaft (2);

a connecting rod (24) pivotally connected to said crankshaft pin (22);

weaving blade drive means (6) including a first rocking lever (28) pivotally connected to said connecting rod (24) and a shaft (30) coupled to said first rocking lever (28); and weft needle drive means (4) including a first coupling rod (40*a*), said first rocking lever (28) being pivotally connected to said first coupling rod (40*a*) and being coupled to said shaft (30), a second rocking lever (42*a*) pivotally connected to said first coupling rod (40*a*), an intermediate shaft (44) parallel to said main drive shaft (2) and coupled to said second rocking lever (42*a*) and supporting a fourth rocker arm (46), a second coupling rod (48) pivotally connected to said third rocker arm (46), a fourth rocker arm (50*a*) pivotally connected to said second coupling rod (48), a vertical shaft (52) mounting said fourth rocker arm (50*a*), a sickle-shaped weft needle (54) connected to said fourth rocker arm (50*a*) such that said weft needle (54) is movable in and out of said warp compartment (14), said weaving blade drive (6) being movable to a mean movement phase, said first coupling rod (40*a*) during said mean movement phase of the weaving blade drive (6) forming an angle of about 90° together with said first and second connected rocker levers (28; 42*a*)

6. Needle-ribbon weaving machine as defined in claim 5, wherein said first and second rocker levers (28; 42*a*) are directed in an identical direction.

* * * * *